United States Patent [19]

Hoefler

[11] Patent Number: 4,976,367

[45] Date of Patent: Dec. 11, 1990

[54] EASILY EMPTIED FOOD CAN

[76] Inventor: Raphael A. Hoefler, 8181 19th St., Westminster, Calif. 92683

[21] Appl. No.: 474,208

[22] Filed: Jan. 31, 1990

Related U.S. Application Data

[63] Continuation-in-part of Ser. No. 329,948, Mar. 29, 1989, abandoned.

[51] Int. Cl.[5] ..... B65D 17/50; B67B 7/24

[52] U.S. Cl. ..... 220/260; 220/66; 220/270; 220/359; 220/367; 222/1; 222/394; 426/115; 426/131; 426/389

[58] Field of Search ..... 220/1 BC, 254, 260, 220/359, 367, 66, 67; 426/115, 131, 389; 222/335, 478, 481, 532, 537, 541, 1, 394

[56] References Cited

U.S. PATENT DOCUMENTS

| | | | |
|---|---|---|---|
| 1,328,937 | 1/1920 | Wilbur | 220/1 BC |
| 3,172,386 | 3/1965 | West | 220/DIG. 13 X |
| 3,568,875 | 3/1971 | Olan | 220/270 |
| 3,680,828 | 8/1972 | Swett | 220/355 X |
| 3,692,202 | 9/1972 | Parlagreco | 220/1 BC |
| 3,782,609 | 1/1974 | Zucconi | 222/394 |
| 4,024,980 | 5/1977 | Kneusel | 220/260 |
| 4,135,637 | 1/1979 | Hannula | 220/271 |
| 4,140,241 | 2/1979 | Erlandson | 220/359 |
| 4,405,056 | 9/1983 | Patterson | 220/271 |
| 4,412,644 | 11/1983 | La Fever | 220/359 X |
| 4,706,849 | 11/1987 | Ryan | 222/80 |
| 4,883,198 | 11/1989 | Manska | 222/1 |

*Primary Examiner*—Stephen Marcus
*Assistant Examiner*—Nova Stucker

[57] ABSTRACT

A container for food or the like comprises a cylindrical wall enclosed by a top and a bottom lid. The cylindrical wall has a slight angle, thereby being wider at the top lid than at the bottom lid. The bottom lid contains a round vent hole having its lip drawn over in the direction of the interior of the container. An air-tight vent seal tab covers the vent hole. With the top lid removed, the container is inverted so that the bottom lid is facing upward, and then the vent seal tab is removed. A common drinking straw is inserted into the vent hole and is sealed therein by the vent hole lip. Mouth pressure is applied to the drinking straw. This pressure and the force due to gravity, together, force the contents of the container to start to move downward toward the open top lid. As initial motion occurs the contents looses contact with the sidewall of the container because of the slight angle and thereby is easily removed.

2 Claims, 2 Drawing Sheets

EASILY EMPTIED FOOD CAN

This application is a continuation-in-part of application Ser. No. 07/329,948 filed Mar. 29, 1989, now abandoned.

BACKGROUND OF THE INVENTION

This invention relates to containers such as metal cans used for storage of foodstuffs. More specifically this invention relates to containers having features which permit the easy removal of solid or semisolid contents.

DESCRIPTION OF THE PRIOR ART

Common food cans are most often opened by the use of a "can opener". This can opening device uses one of several methods to sever the top of the can which allows said top to be removed or folded outwardly, thus providing access to the can's contents. Several easy opening can tops are described in the art which provide for opening without the use of an external opener. U.S. Pat. No. 4,135,637 by Hannula shows an improved easy open closure system which allows access to a liquid product and provides a vent hole on the top surface of the container. U.S. Pat. No. 4,405,056 by Patterson teaches a container closure system with a vent opening through the closure tape, again the vent being on the top surface of the container and being best applied to liquid contents. U.S. Pat. No. 4,024,980 by Kneusel shows a can end having a closure plug. This container has a vent plug extending into the vent hole and sealingly engages the end panel. Other methods which appear in the prior art and in common use are the loop grip peel-off can top and the sealing tape strip which is removed using a key type device such as is popular for sardine cans.

The prior art does not deal specifically with the profile of expediting the removal of solid or semisolid contents which are difficult to remove from the container. None of the prior art disclosures show the combination of features and capabilities of the instant invention. It is the applicants opinion that the instant invention is not shown nor predicted by the prior art and that the present invention is an effective device for the intended use providing certain advantages to be described in detail.

SUMMARY OF THE INVENTION AND OBJECTS

The invention is a container for food or other contents which is easily emptied after removal of the top lid. The container is similar to the common steel cans used for dog food or the like which require removal of the top lid with a can opening device, said device being commonly found in most households. The unique aspects of the present invention are first, that the can is formed with a slight draft angle such that the top lid is larger than the bottom lid. The draft angle is between one and three degrees. This is enough to allow the food contents to free itself from the walls of the container and fall out of the top of the can when the can is in the inverted orientation. The second unique feature of the invention is that the can has a vent hole cut into the bottom lid surface, said vent hole being covered with a flexible strip which is bonded to the lid surface but which can be pulled off to expedite contents removal through venting.

It is one object of the instant invention to provide a new and unique device designed to overcome the drawback of having to empty common food cans and other containers by using a spoon or other implement.

Another object and prominent feature of the within invention is to provide a container having a slight draft angle which permits the contents to fall out of the can in one piece.

An alternate object and prominent feature of the within invention is to provide a container having an easy opening hole in the bottom lid which provides a vent to assure the easy removal of the can's contents.

These, together with the various ancillary objects and features of the invention which will become apparent as the following description proceeds, are attained by this unique container, the preferred embodiment thereof being shown in the accompanying drawings, by way of example only.

DRAWING REFERENCE NUMERALS

Figure 1:
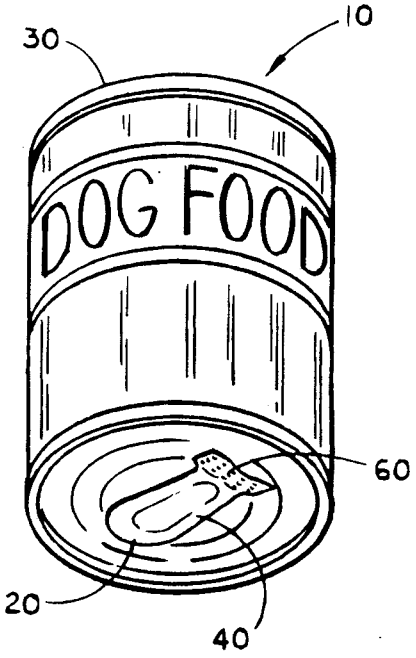
FIG. 1 is a perspective drawing of the invention.

10 Container
15 Side wall
20 Bottom lid
80 Drinking Straw
90 Vent hole lip
30 Top lid
40 Vent seal tab
45 Adhesive
50 Vent hole
60 Tab grip
70 Contents

DESCRIPTION OF THE PREFERRED EMBODIMENT

Figure 4:
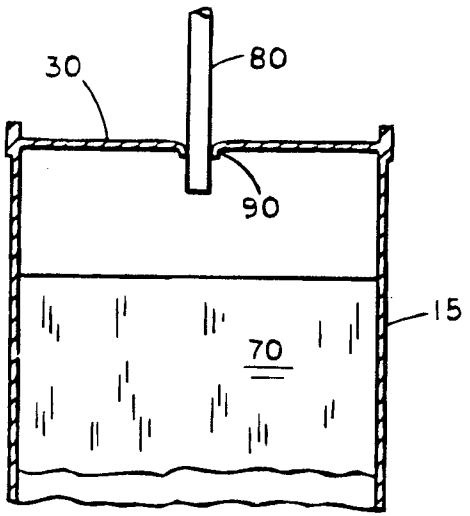
FIG. 4 is a partial crosssection view of FIG. 3 showing details of drinking straw invention and sealing at the vent hole lip.
Figure 3:
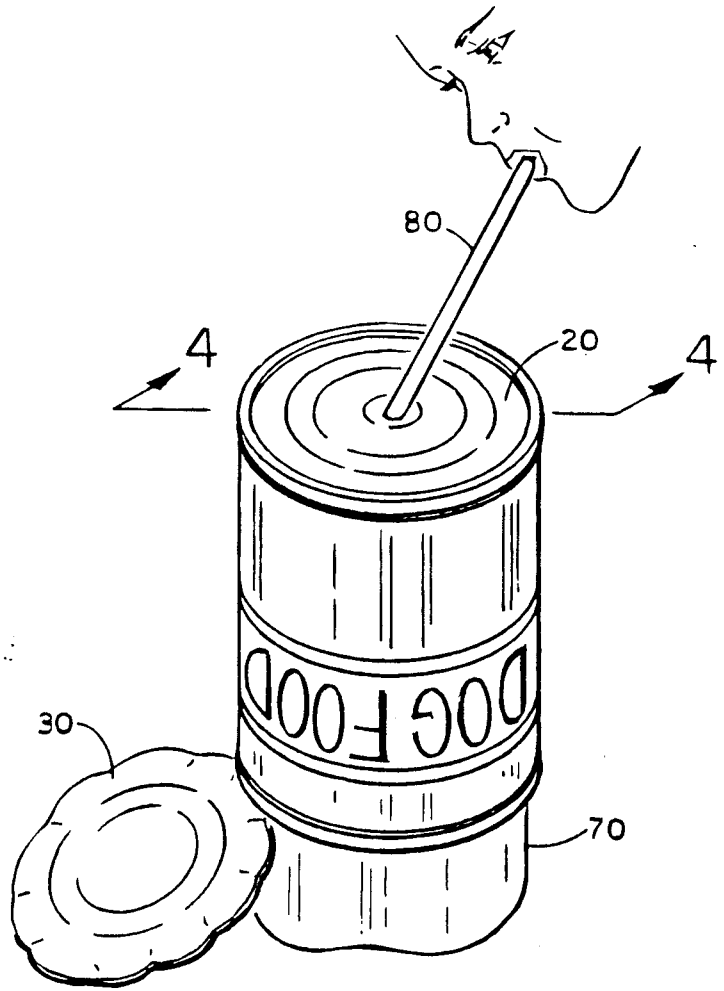
FIG. 3 is a perspective drawing showing a method of applying air pressure to release the contents of the container.

Referring to FIG. 1, container 10 has side wall 15 which is closed at one end by bottom lid 20 and is further closed at the opposite end by top lid 30 where bottom lid 20 is slightly smaller in diameter than top lid 30 so that side wall 15 deviates from a true cylinder by a total included angle of from two to six degrees. Top lid 30 is attached to side wall 15 in such manner as to be opened using a common can opening device. Bottom lid 20 is permanently sealed to side wall 15. Bottom lid 20 contains vent hole 50 which is covered by vent seal tab 40. Vent seal tab 40 is attached to bottom lid 20 with adhesive 45 except for tab grip 60 which is free of adhesive 45. With reference to FIGS. 3 and 4, there is shown the instant invention and method of applying air pressure to the interior of container 10. Vent hole 50, is a circular opening having vent hole lip 90 rolled over in the direction of the interior of container 10. Drinking straw 80 is a common paper or plastic drinking straw, tightly fitting within vent hole lip 90.

OPERATION OF THE INVENTION

Figure 2:
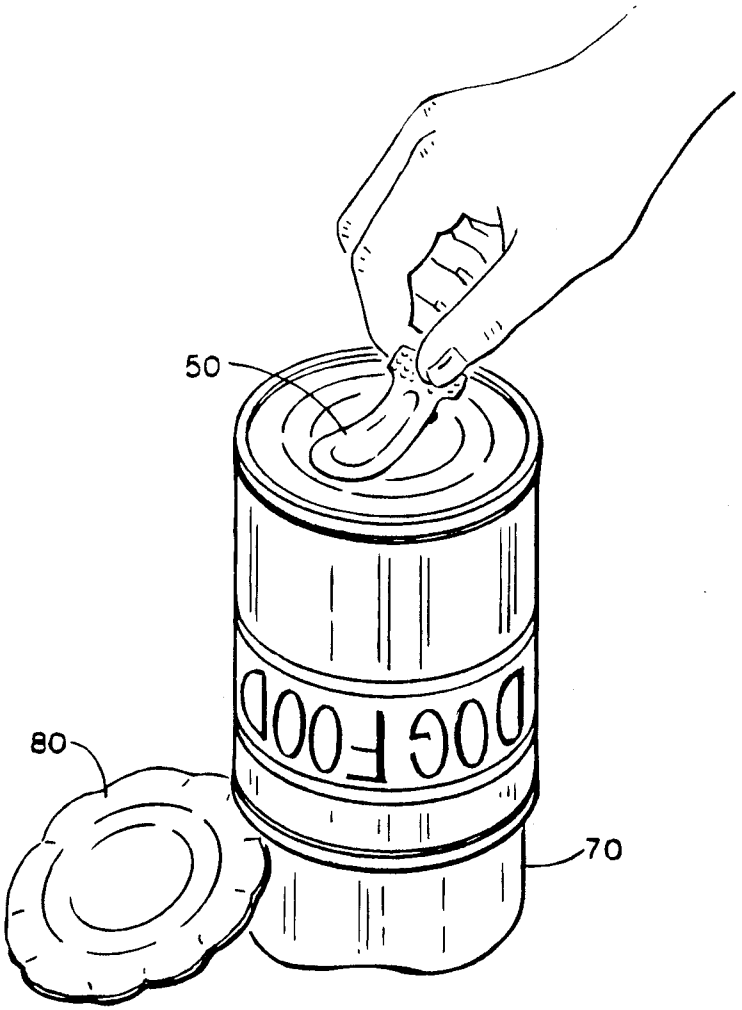
FIG. 2 is a perspective drawing of the invention showing the method by which the can's contents are easily removed in one piece.

Referring to FIG. 2, top lid 30 is opened with a common can opening device and removed or peeled back out of the way of contents 70. Vent seal tab 40 is removed exposing vent hole 50. Contents 70 is then removed by shaking container 10 to dislodge contents 70 in one piece. Due to the angle of side wall 15, contents 70 looses contact with side wall 15 as soon as contents 70 starts to move out of container 10.

An alternate method of removing contents 70 from container 10 is to place drinking straw 80 into vent hole 50, and apply mouth pressure at the free end of drinking straw 80. By establishing a positive pressure on the interior of container 10, contents 70 are induced to move toward open top lid 30.

Having thus described my invention what I claim as new, useful and non-obvious and, accordingly secure by Letters Patent of the United States is:

1. An easily emptied container comprising a side wall made of sheet material formed into a closed shape having a top and a bottom open end defined by the edges of said sheet material on opposite ends, said top end being slightly larger than said bottom end, a top lid sealed to said top open end of said container side wall, a bottom lid sealed to said bottom open end of said container side wall, said bottom lid having a round vent hole, said vent hole having a vent hole lip which is peened over in the direction of the interior of said container, said vent hole lip having a diameter approximating that of a common drinking straw whereby the insertion of said drinking straw into said vent hole lip results in an air tight fit between said drinking straw and said vent hole lip, said vent hole being covered by a removable vent seal tab, a contents for storage within said container, whereby, the removal of said vent seal tab and said top lid allow said container to be easily emptied when said container is inverted.

2. A method of emptying a container of solid contents especially where said contents are tightly packed into said container, said container being of air tight construction having at least one removable lid and at least one vent hole located in said enclosure at a point roughly opposite to said lid, said vent hole being sealed by a vent seal tab, said method comprising the steps: (a) removing said removable lid, (b) orienting said container such that said vent hole faces upward, (c) removing said vent hole tab, (d) inserting a common drinking straw into said vent hole, (e) introducing positive pressure into said container through said drinking straw and thereby forcing said contents to be dislodged from said container.

* * * * *